US008928223B2

(12) United States Patent
Higashi

(10) Patent No.: US 8,928,223 B2
(45) Date of Patent: Jan. 6, 2015

(54) MAGNETRON AND MICROWAVE OVEN THEREWITH

(75) Inventor: Masatoshi Higashi, Hokkaido (JP)

(73) Assignee: Toshiba Hokuto Electronics Corporation, Asahikawa-Shi, Hokkaido (JP)

( * ) Notice: Subject to any disclaimer, the term of this patent is extended or adjusted under 35 U.S.C. 154(b) by 646 days.

(21) Appl. No.: 13/070,694

(22) Filed: Mar. 24, 2011

(65) Prior Publication Data

US 2011/0234093 A1 Sep. 29, 2011

(30) Foreign Application Priority Data

Mar. 25, 2010 (JP) ..... 2010-069960

(51) Int. Cl.
*H01J 25/50* (2006.01)
*H01J 23/22* (2006.01)
*H01J 25/587* (2006.01)

(52) U.S. Cl.
CPC ..... *H01J 25/587* (2013.01); *H01J 23/22* (2013.01)
USPC ..... 315/39.51; 315/39.69; 315/39.71; 315/39.75

(58) Field of Classification Search
CPC ..... H01J 23/22; H03B 9/10
USPC ..... 315/39.51, 39.59
See application file for complete search history.

(56) References Cited

U.S. PATENT DOCUMENTS

| | | | | |
|---|---|---|---|---|
| 4,365,185 | A * | 12/1982 | Brady et al. | 315/39.69 |
| 4,743,805 | A * | 5/1988 | Takada | 315/39.75 |
| 5,635,797 | A * | 6/1997 | Kitakaze et al. | 315/39.51 |
| 6,653,788 | B2 * | 11/2003 | Ogura et al. | 315/39.51 |
| 6,670,761 | B1 * | 12/2003 | Lee et al. | 315/39.69 |
| 6,756,735 | B2 * | 6/2004 | Lee et al. | 315/39.51 |
| 7,026,762 | B2 * | 4/2006 | Shon et al. | 315/39.51 |
| 7,122,773 | B2 * | 10/2006 | Yang | 219/761 |
| 7,220,949 | B2 * | 5/2007 | Lee et al. | 219/761 |

(Continued)

FOREIGN PATENT DOCUMENTS

| | | |
|---|---|---|
| EP | 0 915 494 A2 | 5/1999 |
| JP | 50-24033 | 7/1975 |

(Continued)

OTHER PUBLICATIONS

European Search Report, Appln. No. 11 15 9035, Dated Dec. 16, 2011.

*Primary Examiner* — Douglas W Owens
*Assistant Examiner* — Srinivas Sathiraju
(74) *Attorney, Agent, or Firm* — Banner & Witcoff, Ltd.

(57) ABSTRACT

A magnetron has an anode cylinder, ten vanes, three strap rings. The ten vanes are fixed to an inner surface of the anode cylinder and arranged in a radial pattern of which center is at an axis of the anode cylinder. Each of the three strap rings connects vanes that are alternatively arranged. A first strap ring and a third strap ring are arranged on a first end of the vanes in a direction of axis, and a second strap ring is arranged on a second end that is opposite to the first end. Outer diameter of the second strap ring is equal to inner diameter of the first strap ring and outer diameter of the third strap ring is equal to inner diameter of the second strap ring.

15 Claims, 13 Drawing Sheets

(56) References Cited

U.S. PATENT DOCUMENTS

| | | | | |
|---|---|---|---|---|
| 7,279,842 | B2 * | 10/2007 | Mulcahy et al. | 315/39.69 |
| 7,375,470 | B2 * | 5/2008 | Baek et al. | 315/39.51 |
| 7,906,912 | B2 * | 3/2011 | Ishii et al. | 315/39.51 |
| 2009/0066252 | A1 * | 3/2009 | Higashi | 315/39.51 |
| 2011/0234093 | A1 * | 9/2011 | Higashi | 315/39.51 |

FOREIGN PATENT DOCUMENTS

| | | | |
|---|---|---|---|
| JP | 5020433 | | 7/1975 |
| JP | 51 112450 | U | 9/1976 |
| JP | 61-183054 | | 11/1986 |
| JP | 05-128976 | | 5/1993 |
| JP | 8 017354 | A | 1/1996 |
| JP | 2009-081018 | | 4/2009 |

* cited by examiner

FIG.4

| | | first embodiment | reference 1 | reference 2 |
|---|---|---|---|---|
| Dimensions of largest strap ring (41, 141a, 141b, 241) | outer diameter [mm] | 19 | 19 | 19 |
| | inner diameter [mm] | 17.29 | 17.57 | 17.19 |
| | thickness [mm] | 0.9 | 0.9 | 1.2 |
| Dimensions of second strap ring | outer diameter [mm] | 17.29 | (none) | (none) |
| | inner diameter [mm] | 15.62 | | |
| | thickness [mm] | 0.9 | | |
| Dimensions of the smallest strap ring (43, 143a, 143b, 243) | outer diameter [mm] | 15.62 | 15.38 | 16.11 |
| | inner diameter [mm] | 13.8 | 13.8 | 13.8 |
| | thickness [mm] | 0.9 | 0.9 | 1.2 |
| Average cross sectional area of strap ring | absolute value [$mm^2$] | 0.780 | 0.677 | 1.236 |
| | ratio | 1.15 | 1 | 1.83 |
| Average gaps between vane-strap ring and small/large strap rings | absolute value [mm] | 0.709 | 1.009 | 0.560 |
| | ratio | 0.70 | 1 | 0.56 |

MAGNETRON AND MICROWAVE OVEN THEREWITH

CROSS REFERENCE TO RELATED APPLICATION

This application is based upon and claims the benefit of priority from the prior Japanese Patent Application No. 2010-069960 filed on Mar. 25, 2010; the entire content of which is incorporated herein by reference.

BACKGROUND OF THE INVENTION

The present invention relates to a magnetron and a microwave oven therewith.

An anode of a typical magnetron used for a microwave oven has an anode cylinder, an even number of vanes and a plurality of strap rings. The even number of vanes are shaped as plate and arranged in the anode cylinder. The even number of vanes are arranged in a radial pattern of which center is at an axis of the anode cylinder. Each of the plurality of vanes connects vanes arranged alternatively around the axis among the even number of vanes to equalize electrical potential.

For example, a structure in which two strap rings are located in the middle of vane in the direction of axis is disclosed in Japanese Examined Patent Application Publication S50-20433. This structure makes it difficult to manufacture the anode and it takes much time to manufacture the anode.

In Japanese Utility Patent Application Publication S61-183054, a structure in which two large/small strap rings 241, 243 are arranged on only one end of vanes in a direction of an axis 22 as shown in FIG. 11 is disclosed. In Japanese Patent Application Publication H05-128976, a structure in which three, small/medium/large strap rings are arranged on only one end of vanes in a direction of the axis is disclosed. Because a plurality of vanes are arranged on only one end, these structures deteriorate balance of electrical potential at one end and the other end and may raise a problem about oscillation stability.

In Japanese Patent Application Publication 2009-81018, a magnetron having four strap rings including two large strap rings 141*a*, 141*b* of the same diameter and two small strap rings 143*a*, 143*b* of the same diameter as shown in FIG. 12 is disclosed. In this magnetron, two large and small strap rings 141*a*, 143*a* is arranged on one end of vanes 130 in the direction of axis 22 and two large and small strap rings 141*b*, 143*b* is arranged on the other end of vanes in the direction of axis 22. Therefore, it is easy to manufacture and has good balance of electrical potential and good stability of oscillation.

The magnetron disclosed in Japanese Patent Application Publication 2009-81018 has two large strap rings 141*a*, 141*b* of the same diameter and two small strap rings 143*a*, 143*b* of the same diameter. These four strap rings are produced as rings by punching a copper sheet as shown in FIG. 13.

To produce four strap rings in total, two copper sheets of which sides are larger than outer diameter of the large strap rings 141*a*, 141*b* are required. As described, the magnetron disclosed in Japanese Patent Application Publication 2009-81018 utilizes sheet metal at low efficiency and increases material cost.

BRIEF SUMMARY OF THE INVENTION

The present invention has been made to solve the above problems, and has an object of the present invention is to reduce cost of manufacturing a magnetron having good oscillation stability.

According to an aspect of the present invention, there is provided a magnetron comprising: an anode cylinder; an even number of vanes arranged in a radial pattern of which center is at an axis of the anode cylinder, each of the vanes being fixed to an inner surface of the anode cylinder; a first strap ring arranged on a first end of the even number of vanes in a direction of the axis and connecting a plurality of vanes being alternatively arranged around the axis; a second strap ring of which outer diameter is substantially equal to inner diameter of the first strap ring arranged on a second end opposite to the first end of the even number of vanes and connecting a plurality of vanes being alternatively arranged around the axis; and a third strap ring of which outer diameter is equal to or less than inner diameter of the second strap ring or of which inner diameter is equal to or larger than outer diameter of the first strap ring arranged on the first end or the second end and connecting a plurality of vanes being alternatively arranged around the axis.

According to another aspect of the present invention, there is provided a microwave oven having a magnetron, the magnetron comprising: an anode cylinder; an even number of vanes arranged in a radial pattern of which center is at an axis of the anode cylinder, each of the vanes being fixed to an inner surface of the anode cylinder; a first strap ring arranged on a first end of the even number of vanes in a direction of the axis and connecting a plurality of vanes being alternatively arranged around the axis; a second strap ring of which outer diameter is substantially equal to inner diameter of the first strap ring arranged on a second end opposite to the first end of the even number of vanes and connecting a plurality of vanes being alternatively arranged around the axis; and a third strap ring of which outer diameter is equal to or less than inner diameter of the second strap ring or of which inner diameter is equal to or larger than outer diameter of the first strap ring arranged on the first end or the second end and connecting a plurality of vanes being alternatively arranged around the axis.

BRIEF DESCRIPTION OF THE DRAWINGS

The above and other features and advantage of the present invention will become apparent from the discussion herein below of specific, illustrative embodiments thereof presented in conjunction with accompanying drawings, in which:

FIG. 4 is a table that shows one example of dimensions of three strap rings 41-43 according to the first embodiment;

DETAILED DESCRIPTION OF THE INVENTION

Hereinafter, embodiments of magnetron and microwave oven according to the present invention will be described with reference to the drawings. The same symbols are given to same or similar configurations, and duplicated descriptions may be omitted.

First Embodiment

Figure 1:
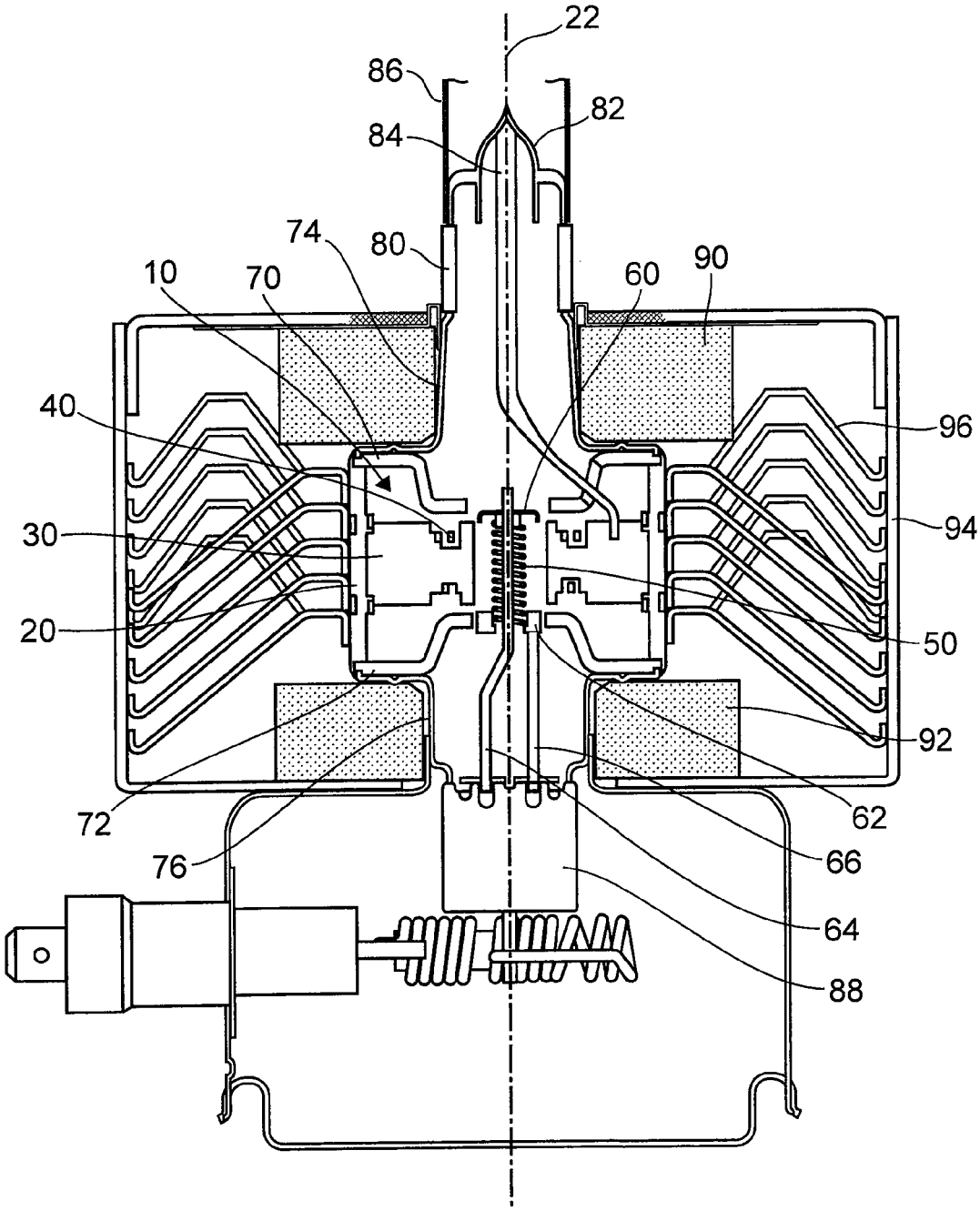
FIG. 1 is a schematic longitudinal sectional view of a magnetron according to the first embodiment.

An outline of a structure of a magnetron according to a first embodiment of the present invention will be illustrated with reference to FIG. 1. FIG. 1 is a schematic longitudinal sectional view of a magnetron according to this embodiment.

An anode 10 has an anode cylinder 20, even number of vanes 30 and a plurality of strap rings 40. The anode cylinder 20 is made of copper, for example, and is formed as a cylinder.

Each vane 30 is made of copper, for example, and is formed as a plate of which shape is a rectangular with cut-outs. The even number of vanes 30 are arranged in a radial pattern of which center is at the axis 22 of the anode cylinder 20. Outer ends of the vanes 30 are fixed to the inner circumferential surface of the anode cylinder 20. Inner ends of the vanes 30 are free ends. The space surrounded by the free ends of the vanes 30 is an electronic interaction space.

The plurality of strap rings 40 are arranged at the both end of the even number of vanes in the direction of the axis 22. Each of the strap rings 40 connects vanes 30 arranged alternatively around the axis 22 among the even number of vanes 30.

A cathode 50 has a filament extending spirally along the axis 22. The cathode 50 is located in the above-mentioned electronic interaction space. The cathode 50 is located apart from the free ends of the even number of vanes 30. The anode 10 and the cathode 50 are an oscillation part of the magnetron.

A disc-shaped end hat 60 is fixed at an output end (an upper end in FIG. 1) of the cathode 50. A ring-shaped end hat 62 is fixed at an input end (a lower end in FIG. 1) of the cathode 50.

A center support rod 64 extends through the center of the filament of the cathode 50. The center support rod 64 is connected electrically to the cathode 50 via the disc-shaped end hat 60. The center support rod 64 and the side support rod 66 support the cathode 50 and supply an electric current to the cathode 50.

A pair of pole pieces 70, 72 is formed like funnel respectively. The pair of pole pieces 70, 72 is connected respectively to the output end (an upper end in FIG. 1) and the input end (a lower end in FIG. 1) of the anode cylinder 20.

A pair of metallic sealing members 74, 76 is formed as a cylinder respectively. The pair of metallic sealing members 74, 76 extends along the axis 22. An end of one metallic sealing member 74 is fixed to the output end of the anode cylinder 20 and the pole piece 70. An end of the other metallic sealing member 76 is fixed to the input end of the anode cylinder 20 and the pole piece 72.

An insulation cylinder 80 is made of ceramic and extends along the axis 22. An end of the insulation cylinder 80 is fixed to an output end (an upper end in FIG. 1) of the metallic sealing member 74. The other end of the insulation cylinder 80 is fixed to an exhausting pipe 82. An antenna 84 is fixed to one of the even number of vanes 30, penetrates the pole piece, extends inside of the metallic sealing member 74 and the insulation cylinder 80 and is led to the exhausting pipe 82. The exhausting pipe 82 holds the tip of the antenna 84 there between. A cap 86 is disposed so as to surround the exhausting pipe 82.

An insulation stem 88 is fixed to an input end (a lower end in FIG. 1) of the metallic sealing member 76.

A pair of magnets 90, 92 is formed as a ring respectively. Each of the pair of magnets 90, 92 is arranged outside of the metallic sealing members 74, 75. The anode cylinder 20 is located between the pair of magnets 90, 92, and the pair of magnets 90, 92 produces a magnetic field parallel to the axis 22. A yoke 94 is provided so as to surround the anode cylinder 20 and the magnets 90, 92. The combination of the pair of magnets 90, 92 and the yoke 94 forms a magnetic circuit. A radiator 96 is disposed between the anode cylinder and the yoke 94, and transfers heat generated during the oscillation.

Figure 2:
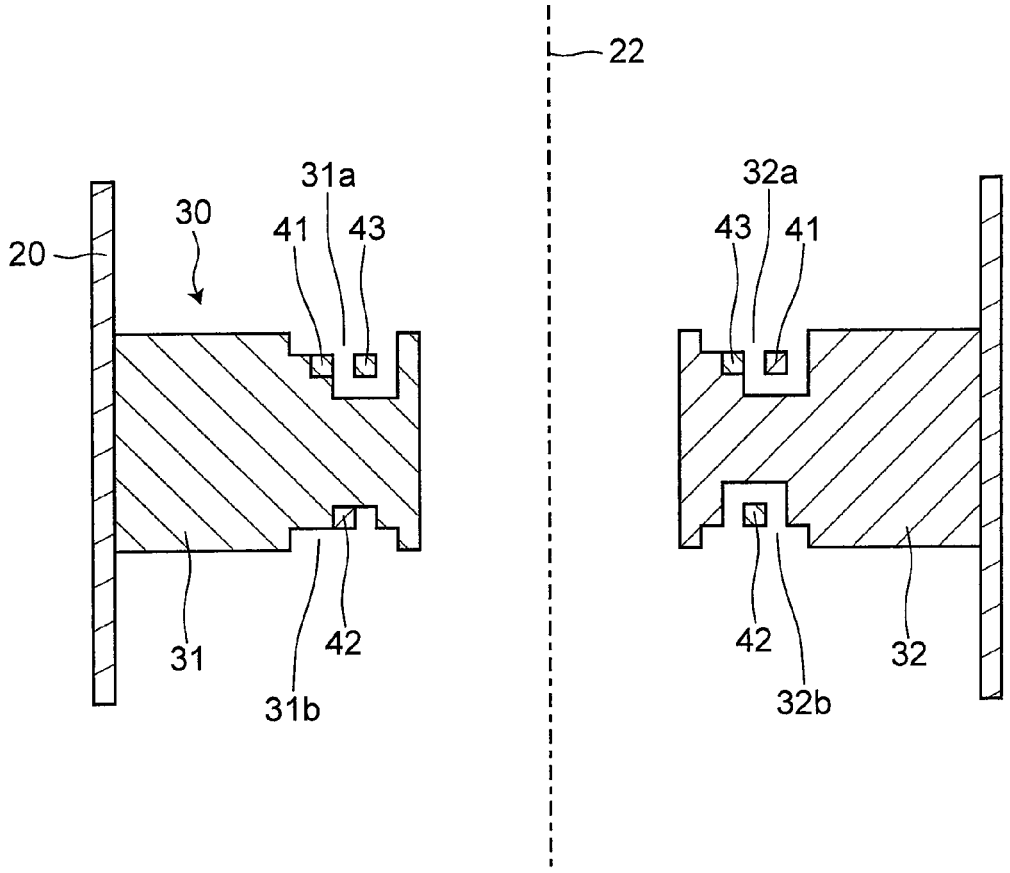
FIG. 2 is a schematic longitudinal view of the anode cylinder, the vanes and the strap rings of the magnetron according to the first embodiment.
Figure 3:
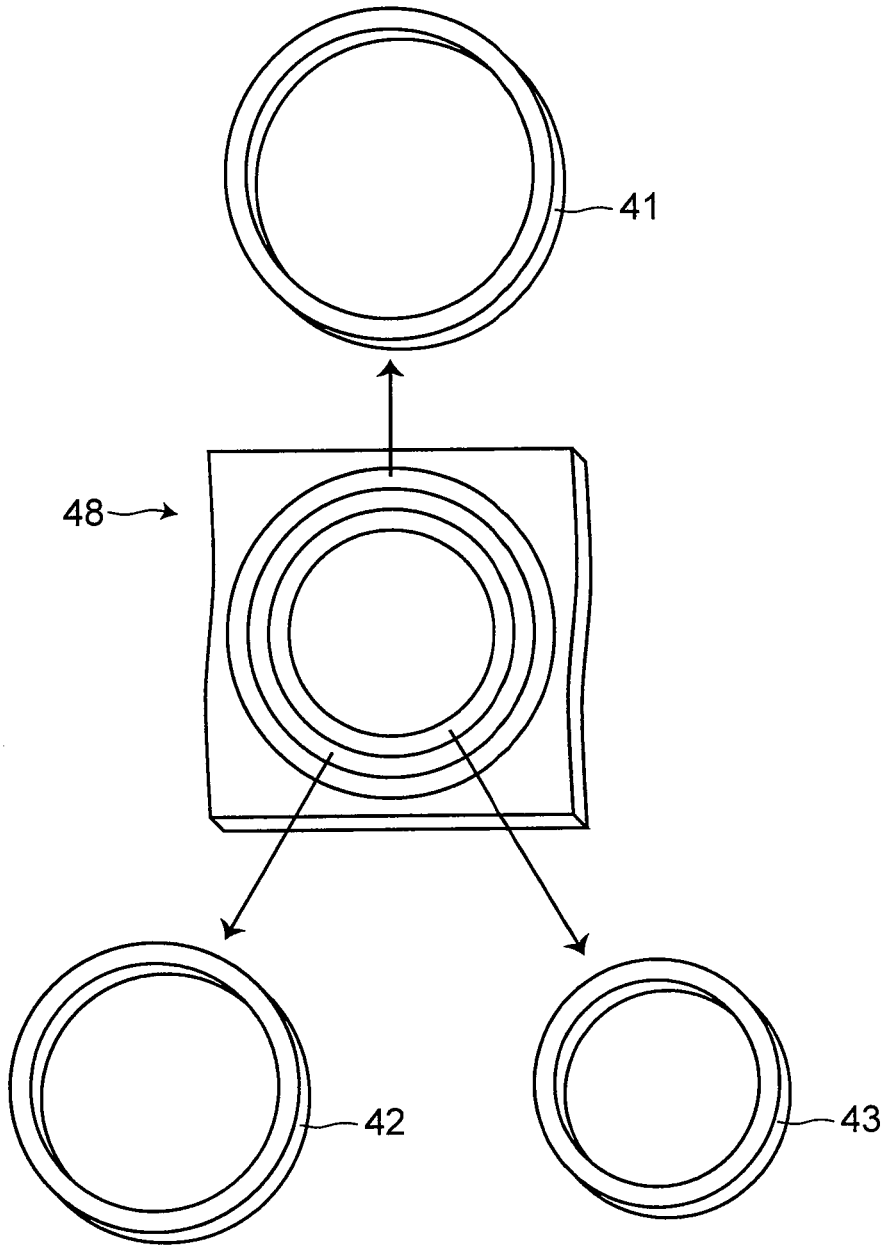
FIG. 3 is a schematic view illustrating how three strap rings of magnetron according to the first embodiment are punched out from a copper sheet.

Next, details of characteristic part of the magnetron according to the present embodiment will be described with reference to FIG. 2 and FIG. 3. FIG. 2 is a schematic longitudinal view of the anode cylinder, the vanes and the strap rings of the magnetron according to this embodiment. FIG. 3 is a schematic view illustrating how three strap rings of magnetron according to this embodiment are punched out from a copper sheet.

According to this embodiment, the magnetron has ten vanes 30, for example. The ten vanes 30 are arranged in the radial pattern of which center is located at the axis 22 in the anode cylinder. The ten vanes 30 include five first vanes 31 and five second vanes 32. The first vanes 31 and the second vanes 32 are arranged alternatively around the axis 22.

On the both ends of each of the five first vanes 31 in the direction of axis 22, different shapes of cut-outs 31*a*, 31*b* are defined respectively. Also, on the both ends of each of the five second vanes 32 in the direction of axis 22, different shapes of cut-outs 32*a*, 32*b* are defined respectively.

According to this embodiment, the magnetron has three strap rings 41-43. Each of the three strap rings 41-43 is made of copper and is formed as a ring. Each of the three strap rings is arranged so that the center thereof is at the axis 22.

A first strap ring 41 is arranged on a first end (an upper end in FIG. 2) of the ten vanes 30 in the direction of axis 22. The first strap ring 41 runs through the cut-outs 31*a* of the five first vanes 31 and the cut-outs 32*a* of the five second vanes 32. The first strap ring 41 is soldered to edges of the cut-outs 31*a* of the first vanes 31 but does not contact with any edge of the cut-outs 32*a* of the second vanes 32. That is, the first strap ring 41 connects electrically the five first vanes 31 with each other.

A second strap ring 42 is arranged on a second end (a lower end in FIG. 2) of the ten vanes 30 in the direction of axis 22. The second strap ring 42 runs through the cut-outs 31*b* of the five first vanes 31 and the cut-outs 32*b* of the five second vanes 32. The second strap ring 41 is soldered to edges of the cut-outs 31*b* of the first vanes 31 but does not contact with any edge of the cut-outs 32*b* of the second vanes 32. That is, the second strap ring 42 connects electrically the five first vanes 31 with each other.

A third strap ring 43 is arranged on the first end (the upper end in FIG. 2) of the ten vanes 30 in the direction of axis 22. The third strap ring 43 runs through the cut-outs 31*a* of the five first vanes 31 and the cut-outs 32*a* of the five second vanes 32. The third strap ring 43 is soldered to edges of the cut-outs 32*a* of the second vanes 32 but does not contact with any edge of the cut-outs 31*b* of the first vanes 31. That is, the third strap ring 43 connects electrically the five second vanes 32 with each other.

The first and second strap rings 41, 42 connecting the first vanes with each other are arranged on the opposite ends of the ten vanes 30 in the direction of the axis 22.

While the magnetron oscillates, the electric potentials of the five first vanes 31 are equal with each other by the first strap ring 41 and the second strap ring 42. Also, the electric potentials of the five second vanes 32 are equal with each other by the third strap ring 43.

As illustrated in FIG. 3, a single copper sheet 48 is punched out four times in stamping work and then the three strap rings 41-43 are formed. Therefore, an inner diameter of the first strap ring 41 is equal to an outer diameter of the second strap ring 42. Also, an inner diameter of the second strap ring 42 is equal to an outer diameter of the third strap ring 43.

A small burr may be formed on the sheared section of the strap rings 41-43 during the punching process. And the copper sheet 48 is held with pressure so that the copper sheet 48 does not deform. Therefore, the inner diameter of the first strap ring 41 and the outer diameter of the second strap ring 42 is substantially equal with each other but may be different slightly and also the inner diameter of the second strap ring 42 and the outer diameter of the third strap ring 43 is substantially equal with each other but may be different slightly.

Functions and advantages of the magnetron according to this embodiment will be described below with reference to FIG. 4. FIG. 4 is a table that shows one example of dimensions of three strap rings 41-43 according to this embodiment. The dimensions of strap rings according to reference 1 and reference 2 that are compared with this embodiment.

Figure 12:
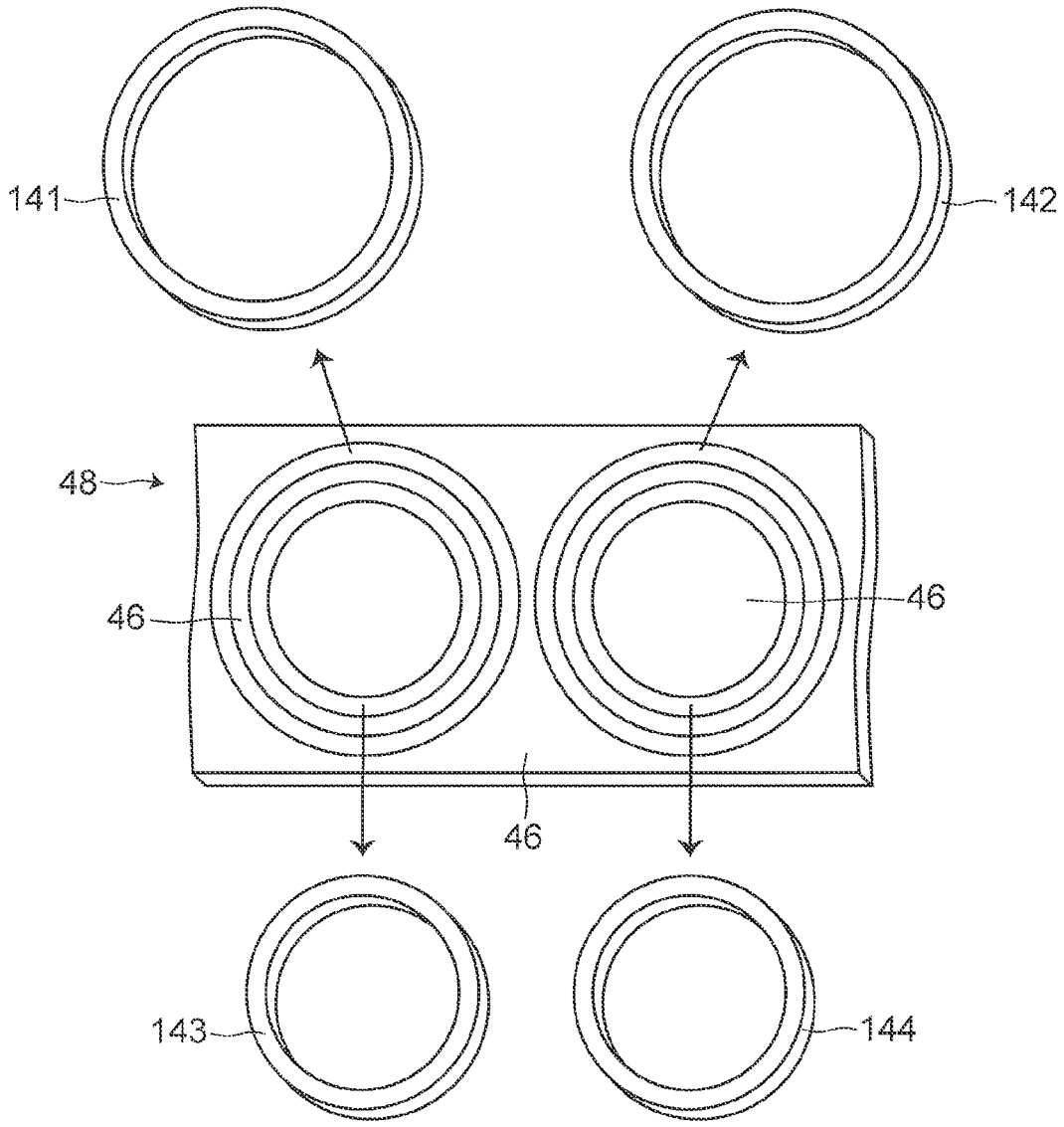
FIG. 12 (PRIOR ART)
FIG. 12 is a schematic longitudinal sectional view of an anode cylinder, vanes and strap rings of another conventional magnetron (reference 1)
Figure 13:
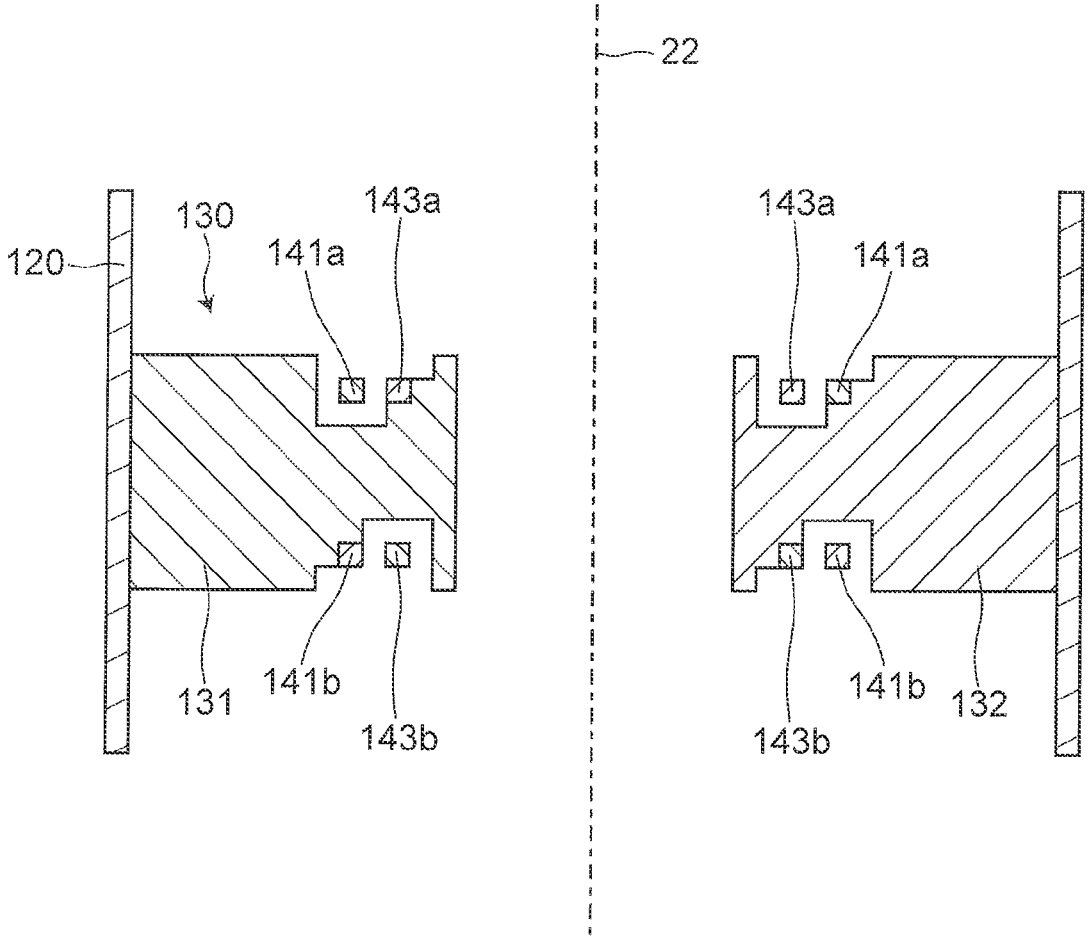
FIG.13 (PRIOR ART)
FIG. 13 is a schematic view illustrating how four strap rings of a conventional magnetron are punched out from a copper sheet.

The magnetron according to reference 1 has four strap rings in total consisting of two large strap rings 141*a*, 141*b* of the same diameter and two small strap rings 143*a*, 143*b* of the same diameter as shown in FIG. 12. Two strap rings consisting of the large and small strap rings 141*a*, 143*a* are arranged on one end of the vanes 130 in the direction of axis 22 and two strap rings consisting of the large and small strap rings 141*b*, 143*b* are arranged on the other end of the vanes 130 in the direction of axis 22.

The magnetron according to reference 2 has two strap rings consisting of large and small strap rings 241, 243 that are arranged on a one end of the vanes 230 in the direction of axis 22.

Here, dimensions of anode cylinder and vanes according to the example of this embodiment, reference 1 and reference 2 are set equal. The maximum diameters of each magnetrons according to the example of this embodiment, reference 1 and reference 2 are set equal. The minimum diameters of each magnetrons according to the example of this, reference 1 and reference 2 are set equal.

Under these conditions, inner diameters and thicknesses of the largest strap rings 41, 141, 241, outer diameters and thicknesses of the smallest strap rings 43, 143, 243, and outer and inner diameters and thicknesses of the second strap ring 42 are designed so that resonance frequencies of these magnetrons are equivalent with each other. In FIG. 4, the dimensions of the strap rings designed in this manner are shown. In addition, average cross sectional areas, average gaps between vane and strap ring and average gaps between small and large strap rings are shown in FIG. 4.

As shown in FIG. 4, by normalizing all of the average cross sectional area of strap rings 141, 143, the average gap between vanes 30 and strap rings 141, 143 and the average gap between large and small strap rings 141, 143 of the magnetron according to reference 1 as unity, the average cross sectional area of the magnetron according to reference 2 is 1.83 and both of the average gaps are 0.56. That is, for adjusting the resonance frequency of the magnetron of structure according to reference 2 to the resonance frequency of the magnetron of structure according to reference 1, the gap between the vanes 230 and the strap rings 241, 243 and the gap between the large and small strap rings 241, 243 have to be smaller, since thicker strap rings 241, 243 are required. In such a case, soldering the strap rings 241, 243 to the vanes 230 may short-circuit the large and small strap rings 241, 243 with each other, the strap ring 241 with the second vane 232, or the strap ring 243 with the first vane 231. Therefore, it is difficult to assemble the anode.

On the other hand, as shown in FIG. 4, by normalizing all of the average cross sectional area of strap rings 141, 143, the average gap between vanes 130 and strap rings 141, 143 and the average gap between large and small strap rings 141, 143 of the magnetron according to reference 1 as unity, the average cross sectional area of the magnetron according to the example of this embodiment is 1.15 and both of the average gaps are 0.70. That is, for adjusting the resonance frequency of the magnetron of structure according to reference 2 to the resonance frequency of the magnetron of structure of the example of the present embodiment, the gap between the vanes 30 and the strap rings 41, 42 and the gap between the large and small strap rings 41, 43 is not excessively small, since excessively thick strap rings 41, 42 are not required. Therefore, according to the example of this embodiment, it is not difficult to assemble the anode 10. As a result, according to the example of this embodiment, a magnetron of which difficulty and characteristic is close to that of the magnetron according to reference 1 can be provided.

According to reference 1, two copper sheets of which sides are equal to the outer diameter of the large strap ring 141 is required for four strap rings 141, 143. On the other hand, according to the example of this embodiment, the inner diameter of the first strap ring 41 is equal to the outer diameter of the second strap ring 42, and the inner diameter of the second strap ring 42 is equal to the outer diameter of the third strap ring 43. Therefore, only one copper sheet of which side is equal to the outer diameter of the first strap ring 41 is required for three strap rings 41-43 according to the example of this embodiment. Further, no ring-shaped scrap is generated by punching. In other words, the example of this embodiment can improve efficiency of utilization of material and reduce material cost.

As described above, according to this embodiment, a magnetron of good oscillation stability can be manufactured at low cost.

Considering easiness of performing press work, easiness of performing frequency adjustment work and performance of a magnetron, it is desired that the width of the second strap ring 42 is 0.8-1.2 times as much as that of the first strap ring 41 and the third strap ring 43.

In addition, the magnetron according to this embodiment has following advantages.

According to reference 1, it is required to punch eight times to produce four strap rings 141, 143. According to reference 2, it is required to punch four times to produce two strap rings 241, 243. On the contrary, according to this embodiment, it is required to punch only four times to produce three strap rings 41-43. Therefore, time for manufacturing and cost for equipments can be reduced.

According to reference 2, since two strap rings 241, 243 are located only one end of the vanes 230 in the direction of the axis 22, characteristics such as load stability and cathode back heat by electrons may be deteriorated. However, according to this embodiment, since two strap rings 41, 43 are located at the first end and one strap ring 42 is located at the second end, the balance of the electronic potentials at the first and second ends and the characteristics such as load stability and cathode back heat by electrons are improved.

In accurate adjustment of the resonance frequency of the magnetron, the resonance frequency is measured after insertion of the antenna into a waveguide and is adjusted by deforming the strap ring at the input side (the second end side) to change the capacitance between the vanes and the strap rings. This adjustment method cannot be used if one of the strap rings 241, 243 is not located at the input side (the second end side) as in the magnetron according to reference 2. However, according to this embodiment, the second strap ring 42 is located at the input side (the second end side). Therefore, by using this adjustment method, the resonance frequency of the magnetron can be adjusted accurately.

Second Embodiment

Figure 5:
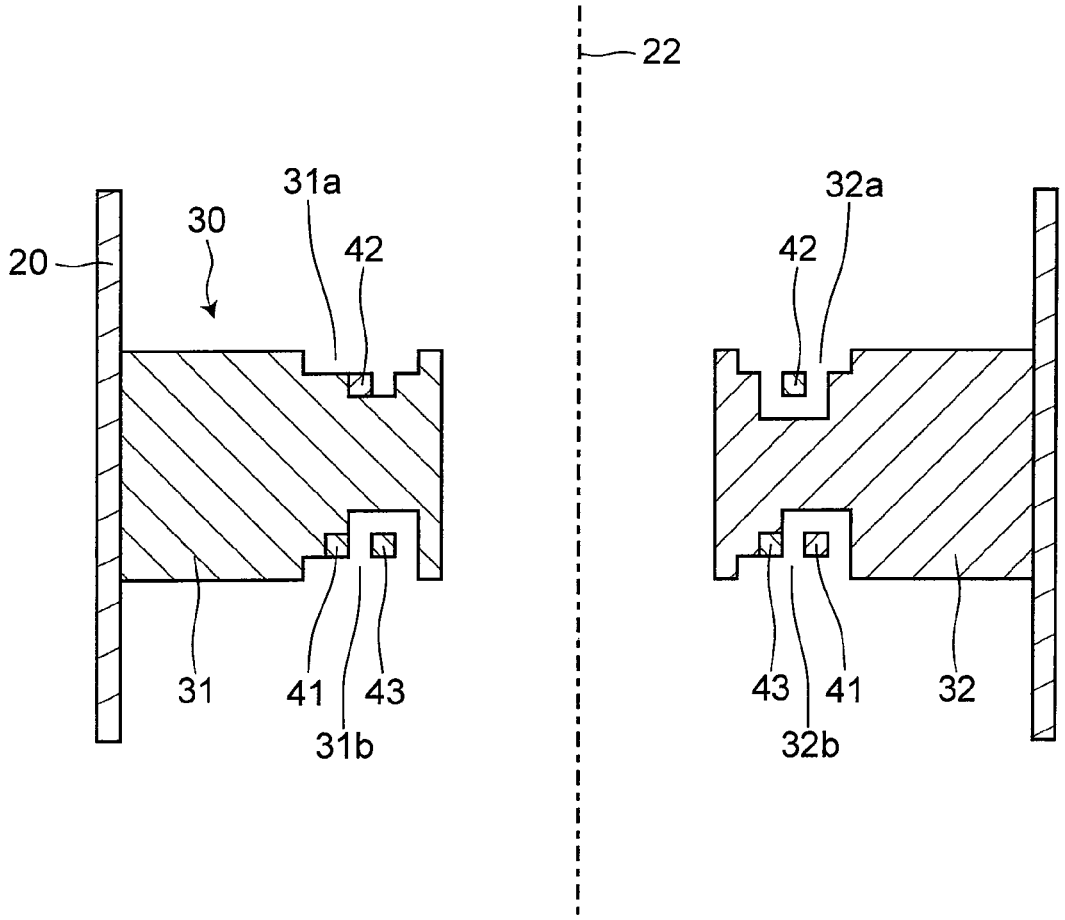
FIG. 5 is a schematic longitudinal sectional view of an anode cylinder, vanes and strap rings of a magnetron according to the second embodiment.

A magnetron and a microwave oven according to a second embodiment of the present invention will be illustrated with reference to FIG. 5. FIG. 5 is a schematic longitudinal sectional view of an anode cylinder, vanes and strap rings of a magnetron according to this embodiment. This embodiment is an example modification of the first embodiment, the same symbols are given to same or similar configurations and duplicated illustrations may be omitted.

According to the first embodiment, the first strap ring 41 and the third strap ring 43 are arranged on the first end of the ten vanes 30 in the direction of the axis 22, and the second strap ring 42 is arranged on the second end of the ten vanes 30 in the direction of axis 22. On the contrary, according to this embodiment, the first strap ring 41 and the third strap ring 43 are arranged on the second end of the ten vanes 30 in the direction of the axis 22, and the second strap ring 42 is arranged on the first end of the ten vanes 30 in the direction of axis 22.

According to this embodiment, advantages similar to the first embodiment can also be achieved.

Third Embodiment

Figure 6:
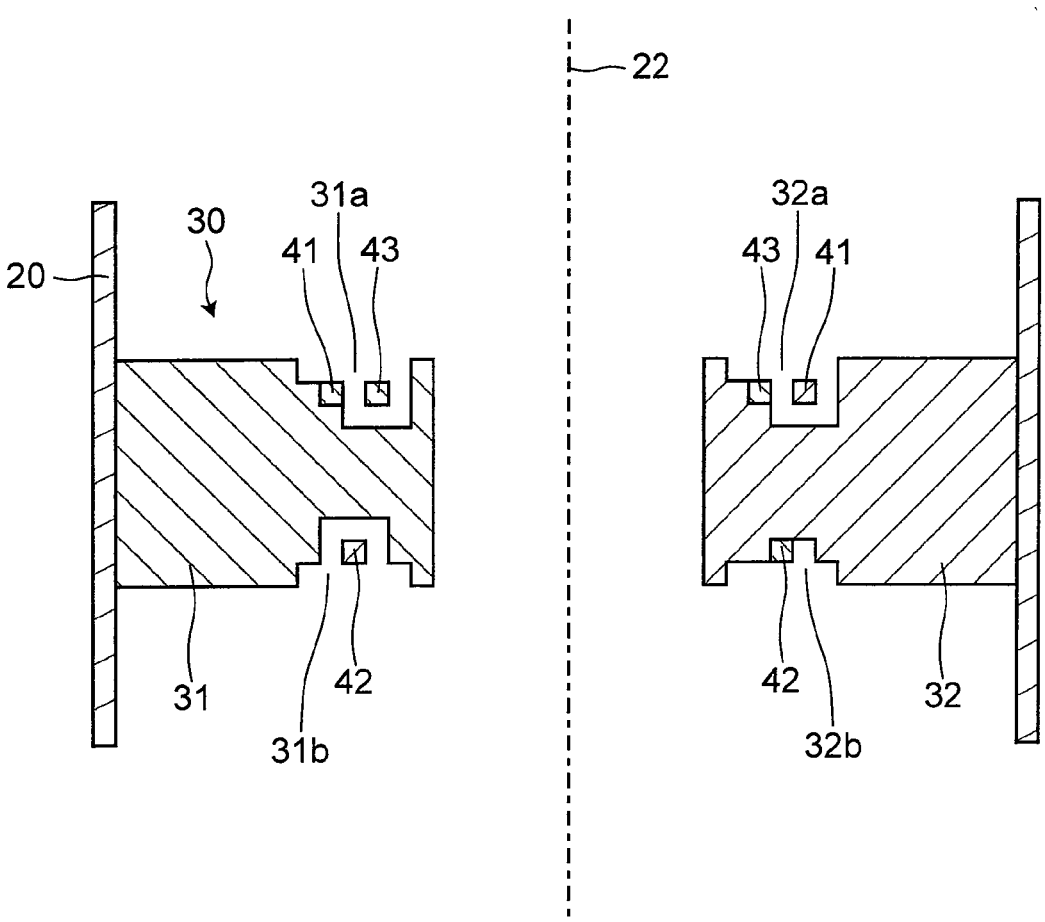
FIG. 6 is a schematic longitudinal sectional view of an anode cylinder, vanes and strap rings of a magnetron according to the third embodiment.

A magnetron and a microwave oven according to a third embodiment of the present invention will be illustrated with reference to FIG. 6. FIG. 6 is a schematic longitudinal sectional view of an anode cylinder, vanes and strap rings of a magnetron according to this embodiment. This embodiment is an example modification of the first embodiment, the same symbols are given to same or similar configurations and duplicated illustrations may be omitted.

According to the first embodiment, the first strap ring 41 and the second strap ring 42 connect the five first vanes 31 with each other and the third strap ring 43 connects the five second vanes 32 with each other. On the contrary, according to this embodiment, the first strap ring 41 connects the five first vanes 31, and the second strap ring 42 and the third strap ring 43 connect the five second vanes 32 with each other.

The second strap ring 42 and the third strap ring 43 that connect the second vanes 32 with each other are arranged at the opposite ends in the direction of the axis 22.

According to this embodiment, advantages similar to the first embodiment can also be achieved.

Fourth Embodiment

Figure 7:
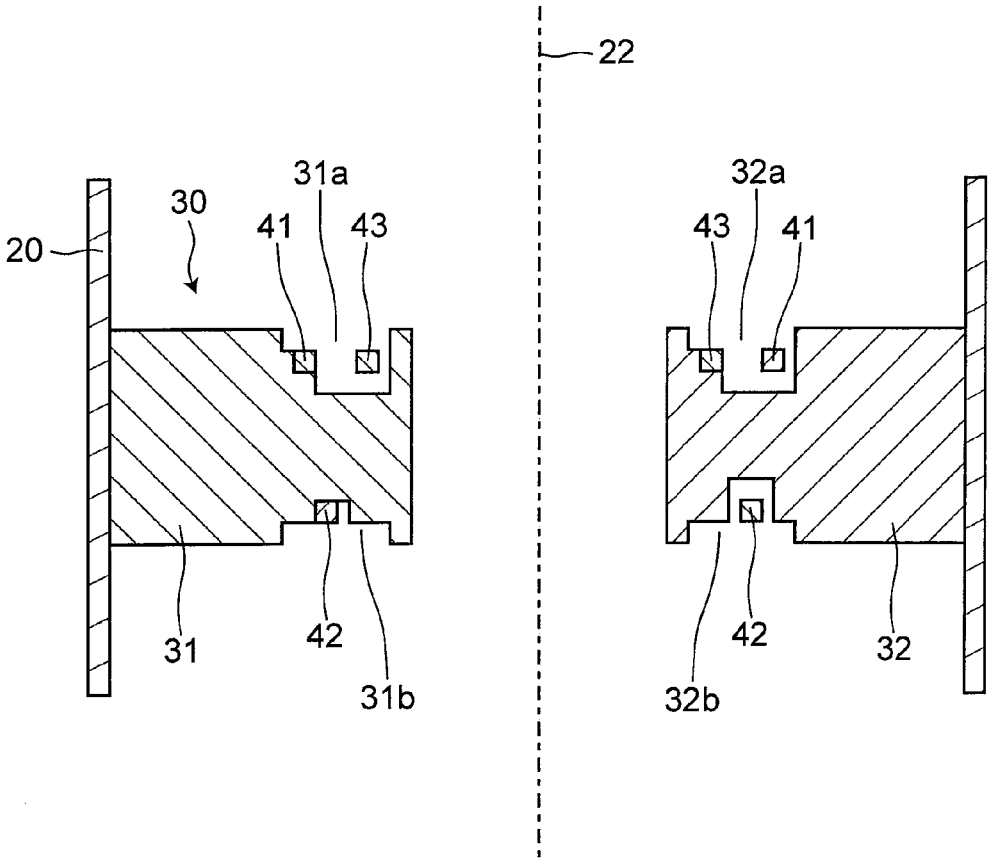
FIG. 7 is a schematic longitudinal sectional view of an anode cylinder, vanes and strap rings of a magnetron according to the fourth embodiment.
Figure 8:
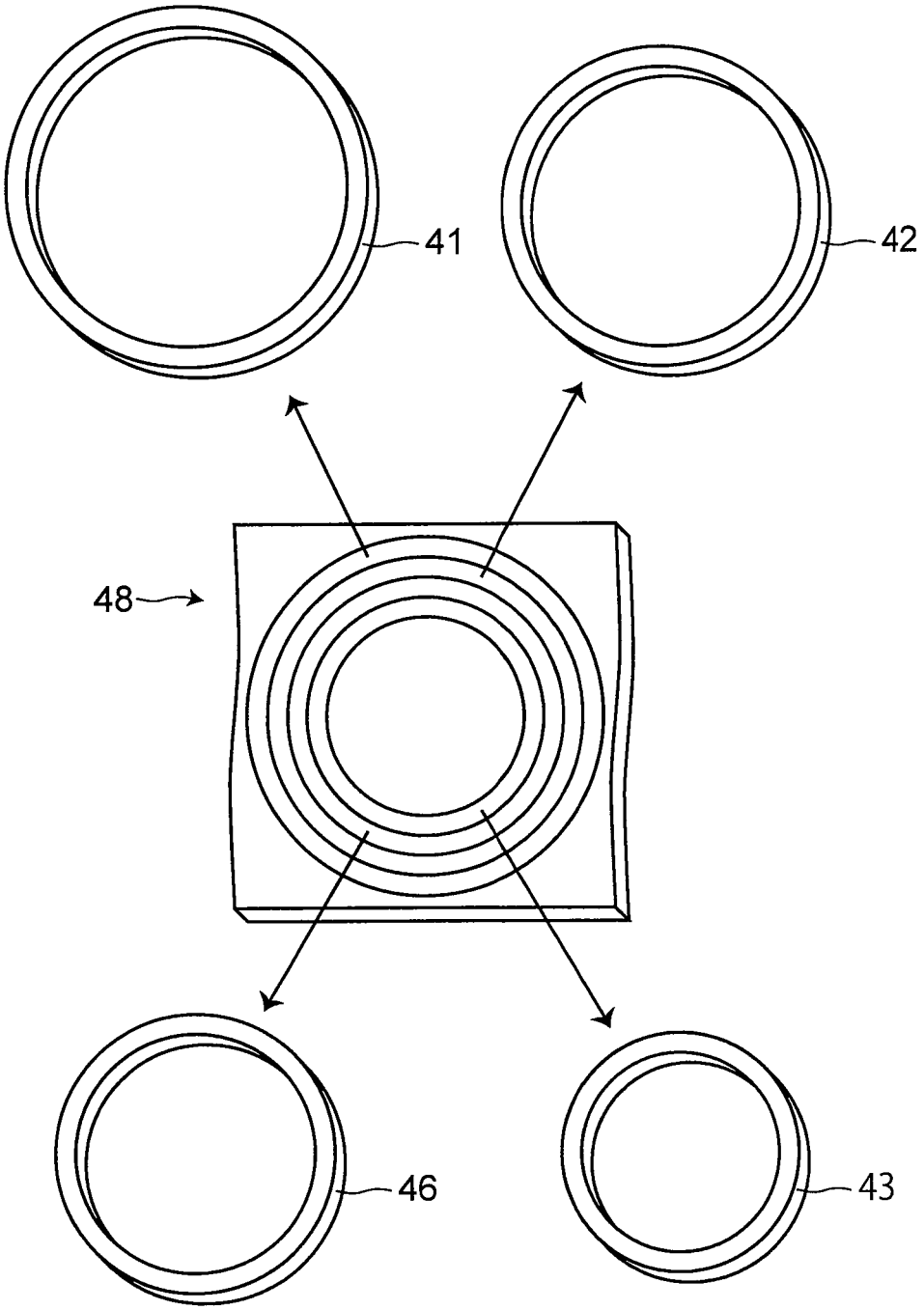
FIG. 8 is a schematic view illustrating how three strap rings of the magnetron are punched out from a copper sheet according to the fourth embodiment.

A magnetron and a microwave oven according to a fourth embodiment of the present invention will be illustrated with reference to FIG. 7 and FIG. 8. FIG. 7 is a schematic longitudinal sectional view of an anode cylinder, vanes and strap rings of a magnetron according to this embodiment. FIG. 8 is a schematic view illustrating how three strap rings of the magnetron are punched out from a copper sheet according to this embodiment. This embodiment is an example modification of the first embodiment, the same symbols are given to same or similar configurations and duplicated illustrations may be omitted.

According to the first embodiment, the inner diameter of the first strap ring 41 is substantially equal to the outer diameter of the second strap ring 42. Also, the inner diameter of the second strap ring 42 is substantially equal to the outer diameter of the third strap ring 43. On the contrary, according to this embodiment, the inner diameter of the first strap ring 41 is substantially equal to the outer diameter of the second strap ring 42, but the outer diameter of the third strap ring 43 is smaller than the inner diameter of the second strap ring 42.

According to this embodiment, by punching five times, three strap rings 41-43 are produced from one copper sheet. As shown in FIG. 8, a ring-shaped scrap 46 is generated in this embodiment, but only one copper sheet of which side is equal to the outer diameter of the first strap ring 41 is required for the three strap rings 41-43.

Fifth Embodiment

Figure 9:
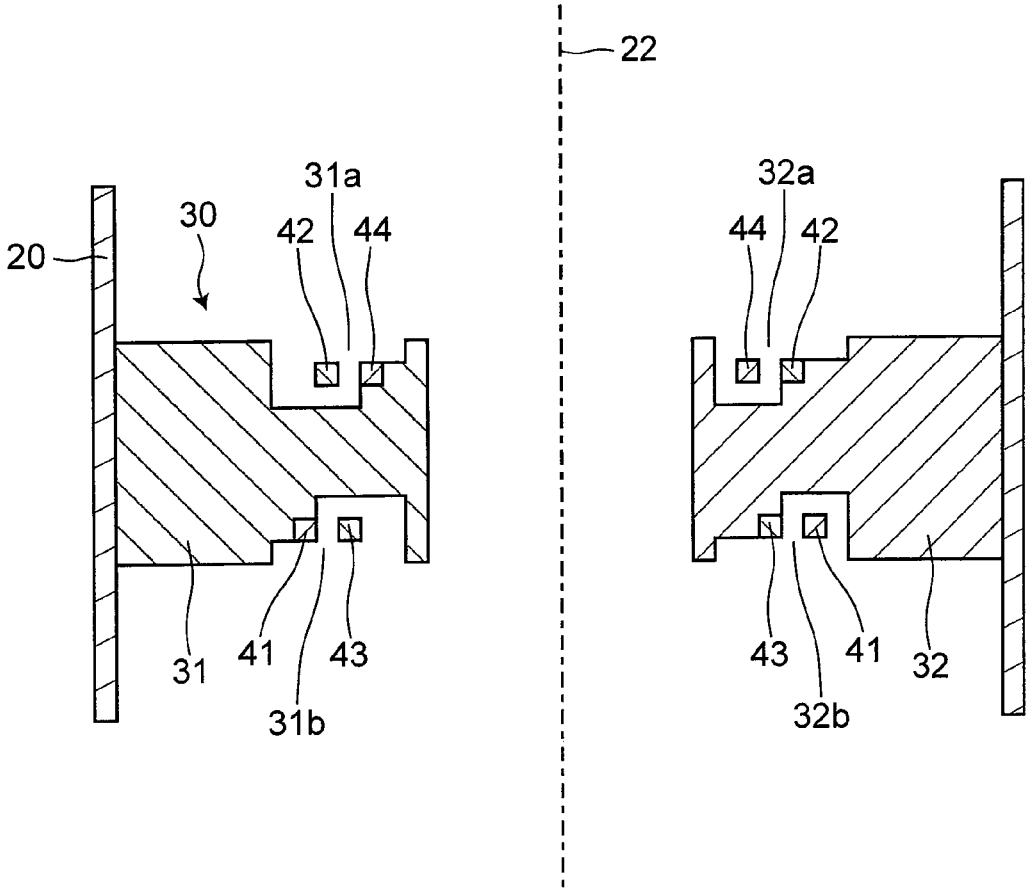
FIG. 9 is a schematic longitudinal sectional view of an anode cylinder, vanes and strap rings of a magnetron according to the fifth embodiment.
Figure 10:
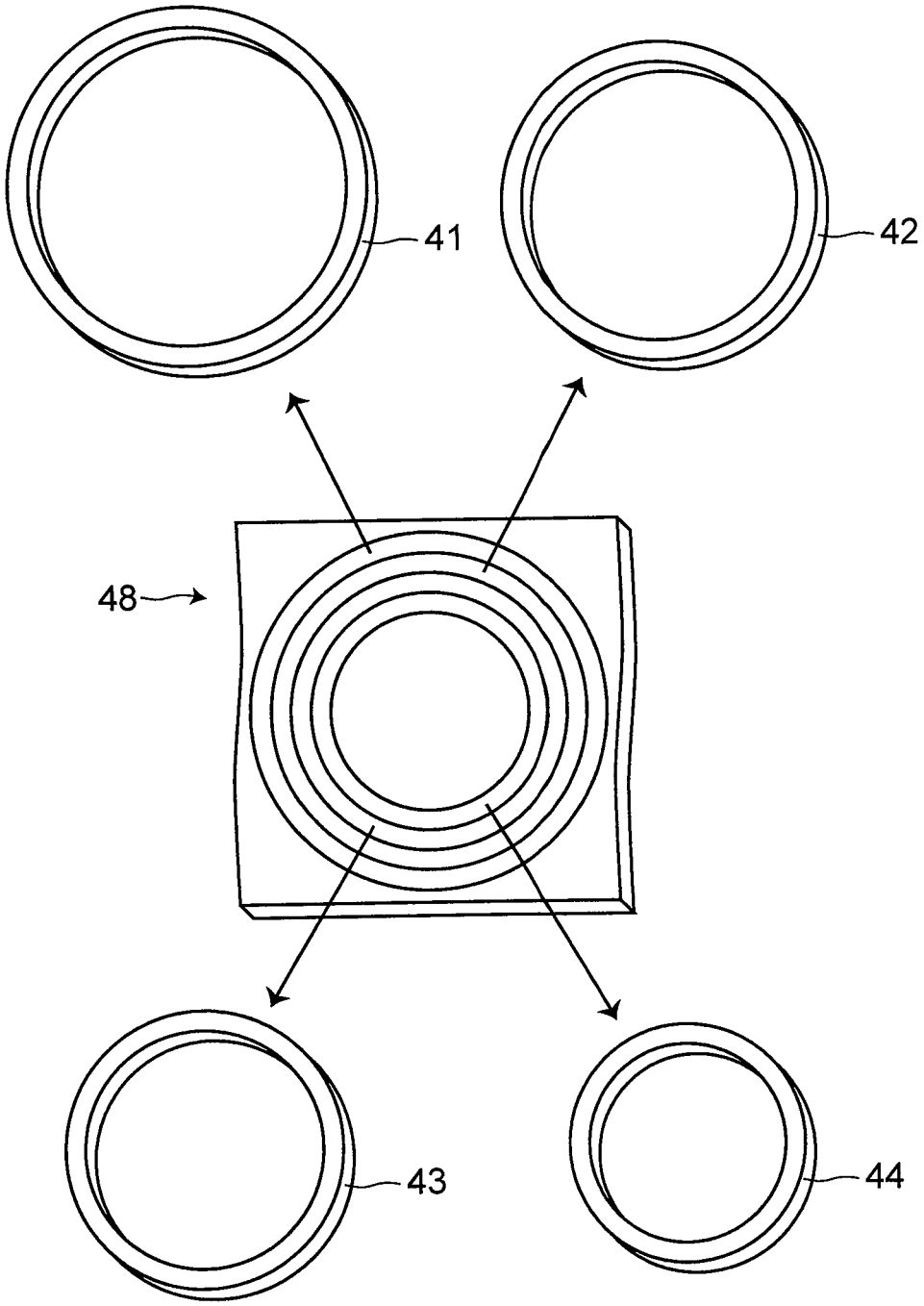
FIG. 10 is a schematic view illustrating how four strap rings of the magnetron of the fifth embodiment are punched out from a copper sheet.
Figure 11:
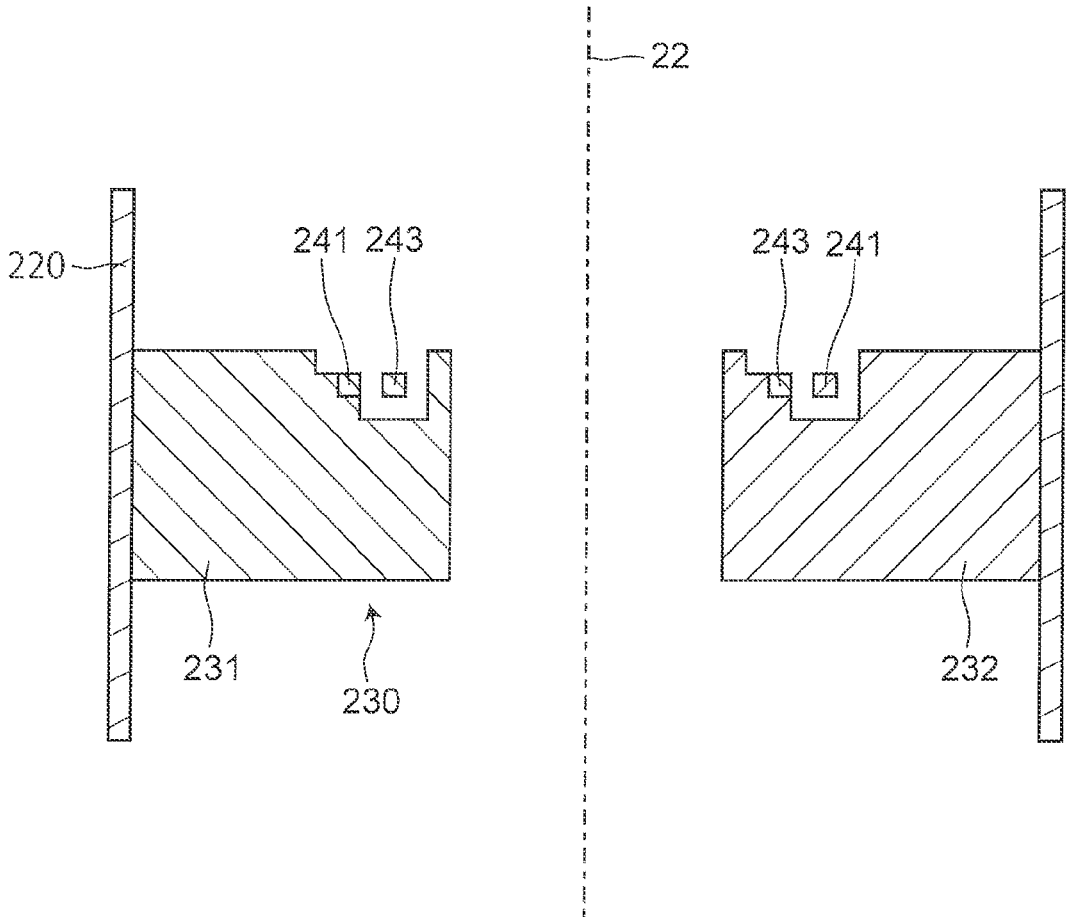
FIG. 11 (PRIOR ART)
FIG. 11 is a schematic longitudinal sectional view of an anode cylinder, vanes and strap rings of a conventional magnetron (reference 2)

A magnetron and a microwave oven according to a fifth embodiment of the present invention will be illustrated with reference to FIG. 9 and FIG. 10. FIG. 9 is a schematic longitudinal sectional view of an anode cylinder, vanes and strap rings of a magnetron according to this embodiment. FIG. 10 is a schematic view illustrating how four strap rings of the magnetron of this embodiment are punched out from a copper sheet. This embodiment is an example modification of the first embodiment, the same symbols are given to same or similar configurations and duplicated illustrations may be omitted.

The magnetron according to the first embodiment has the three strap rings 41-43. On the contrary, the magnetron according to this embodiment has four strap rings 41-44.

The first strap ring 41 is arranged on the second end (lower end in FIG. 9) in the direction of the axis 22. The first strap ring 41 connects the first vanes 31 with each other. The second strap ring 42 is arranged on the first end (upper end in FIG. 9) in the direction of the axis 22. The second strap ring 42 connects the second vanes 32 with each other. The third strap ring 43 is arranged on the second end. The third strap ring 43 connects the second vanes with each other. The fourth strap ring 44 is arranged on the first end. The fourth strap ring 44 connects the first vanes 31 with each other.

The first strap ring 41 and the fourth strap ring 44 that connect the first vanes 31 with each other are arranged on the opposite ends of the ten vanes 30 in the direction of the axis 22. The second strap ring 42 and the third strap ring 43 that connect the second vanes 32 with each other are arranged on the opposite ends of the ten vanes 30 in the direction of the axis 22.

As illustrated in FIG. 10, a single copper sheet 48 is punched out five times in stamping work and then the four strap rings 41-43 are produced. Therefore, the inner diameter of the first strap ring 41 is equal to the outer diameter of the second strap ring 42. Also, the inner diameter of the second strap ring 42 is equal to the outer diameter of the third strap ring 43. In addition, the inner diameter of the third strap ring 43 is equal to the outer diameter of the fourth strap ring 44.

In this embodiment, by punching five times, four strap rings 41-44 are produced from one copper sheet of which side is equal to outer diameter of the first strap ring 41.

Other Embodiment

These embodiments described above are merely examples, so that the present invention is not restricted to these. For example, the strap rings 41, 43 are arranged on the second end and the strap rings 42, 44 are arranged on the first end according to the fifth embodiment, but it may be designed that the strap rings 42, 44 are arranged on the second end and the strap rings 41, 43 are arranged on the first end.

According to the fifth embodiment, the strap rings 41, 44 connect the first vanes 31 with each other and the strap rings 42, 43 connect the second vanes 32 with each other. However, for example, it may be designed that the strap rings 41, 42 connect the first vanes 31 with each other and the strap rings 43, 44 connect the second vanes 32 with each other.

According to the fifth embodiment, the inner diameter of the strap ring 41 is equal to the outer diameter of the strap ring 42. However, the inner diameter of the strap ring can be larger than the outer diameter of the strap ring 42.

Further, above embodiments are illustrated about the magnetron having three or four strap rings, but this invention is applicable to a magnetron having more than four strap rings.

What is claimed is:

1. A magnetron comprising:

an anode cylinder;

an even number of vanes arranged in a radial pattern of which center is at an axis of the anode cylinder, each of the vanes being fixed to an inner surface of the anode cylinder;

a first strap ring arranged on a first end of the even number of vanes in a direction of the axis and connecting a plurality of vanes being alternatively arranged around the axis;

a second strap ring having an outer diameter that is equal to an inner diameter of the first strap ring arranged on a second end opposite to the first end of the even number of vanes and connecting a plurality of vanes being alternatively arranged around the axis;

a third strap ring having an outer diameter that is equal to or less than an inner diameter of the second strap ring or having an inner diameter that is equal to or larger than an outer diameter of the first strap ring arranged on the first end or the second end and connecting a plurality of vanes being alternatively arranged around the axis; and a fourth strap ring having an outer diameter that is equal to or less than the inner diameter of the third strap ring arranged on the first end or the second end and connecting a plurality of vanes being alternatively arranged around the axis.

2. The magnetron of claim 1, wherein the outer diameter of the third strap ring is equal to the inner diameter of the second strap ring and the third strap ring is arranged on the first end.

3. The magnetron of claim 1, wherein the outer diameter of the fourth strap ring is equal to the inner diameter of the third strap ring and the fourth strap ring is arranged on the second end.

4. The magnetron of claim 2, wherein a width of the second strap ring is in a range of 0.8 to 1.2 times of a width of the first strap ring and a width of the third strap ring.

5. The magnetron of claim 1, wherein a width of the second strap ring is in a range of 0.8 to 1.2 times of a width of the first strap ring and a width of the third strap ring.

6. The magnetron of claim 3, wherein a width of the second strap ring is in a range of 0.8 to 1.2 times of a width of the first strap ring and a width of the third strap ring.

7. The magnetron of claim 1, wherein the inner diameter of the third strap ring is equal to the outer diameter of the first strap ring and the third strap ring is arranged on the second end.

8. The magnetron of claim 7, wherein the fourth strap ring includes an inner diameter that is equal to the outer diameter of the third strap ring and is arranged on the first end or the second end.

9. The magnetron of claim 8, wherein the inner diameter of the fourth strap ring is equal to the outer diameter of the third strap ring and arranged on the first end.

10. The magnetron of claim 7, wherein a width of the first strap ring is in a range of 0.8 to 1.2 times of a width of the second strap ring and a width of the third strap ring.

11. The magnetron of claim 8, wherein a width of the first strap ring is in a range of 0.8 to 1.2 times of a width of the second strap ring and a width of the third strap ring.

12. The magnetron of claim 9, wherein a width of the first strap ring is in a range of 0.8 to 1.2 times of a width of the second strap ring and a width of the third strap ring.

13. A microwave oven having a magnetron, the magnetron comprising:

an anode cylinder;

an even number of vanes arranged in a radial pattern of which center is at an axis of the anode cylinder, each of the vanes being fixed to an inner surface of the anode cylinder;

a first strap ring arranged on a first end of the even number of vanes in a direction of the axis and connecting a plurality of vanes being alternatively arranged around the axis;

a second strap ring having an outer diameter that is equal to an inner diameter of the first strap ring arranged on a second end opposite to the first end of the even number of vanes and connecting a plurality of vanes being alternatively arranged around the axis;

a third strap ring of which having an outer diameter that is equal to or less than an inner diameter of the second strap ring or having an inner diameter that is equal to or larger than an outer diameter of the first strap ring arranged on the first end or the second end and connecting a plurality of vanes being alternatively arranged around the axis; and a fourth strap ring having an outer diameter that is equal to or less than the inner diameter of the third strap ring arranged on the first end or the second end and connecting a plurality of vanes being alternatively arranged around the axis.

14. The magnetron of claim 1, wherein a width in a radial direction of a gap between the first strap ring and the third strap ring is equal to a width in the radial direction of the second strap ring.

15. The microwave oven of claim 13, wherein a width in a radial direction of a gap between the first strap ring and the third strap ring is equal to a width in the radial direction of the second strap ring.

* * * * *